US011812815B2

(12) United States Patent
Durham et al.

(10) Patent No.: US 11,812,815 B2
(45) **Date of Patent: *Nov. 14, 2023**

(54) IN-MOLDED HELMET CHINBAR

(71) Applicant: Fox Head, Inc., Irvine, CA (US)

(72) Inventors: David L. Durham, San Clemente, CA (US); Dennis Tan, Long Beach, CA (US)

(73) Assignee: Fox Head, Inc., Irvine, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/974,075

(22) Filed: Oct. 26, 2022

(65) Prior Publication Data

US 2023/0052260 A1 Feb. 16, 2023

Related U.S. Application Data

(63) Continuation of application No. 17/307,847, filed on May 4, 2021, now Pat. No. 11,510,452, which is a (Continued)

(51) Int. Cl.
*A42B 3/20* (2006.01)
*A42B 3/06* (2006.01)
(Continued)

(52) U.S. Cl.
CPC ..... *A42B 3/205* (2013.01); *A42B 3/062* (2013.01); *A42B 3/125* (2013.01); *A42B 3/222* (2013.01); *A42B 3/32* (2013.01); *A42C 2/002* (2013.01)

(58) Field of Classification Search
CPC ..... A42B 3/18; A42B 3/236; A42B 3/225; A42B 3/205; A42B 3/125
See application file for complete search history.

(56) References Cited

U.S. PATENT DOCUMENTS 3,242,500 A * 3/1966 Derr ..... A42B 3/20 2/205
4,024,587 A * 5/1977 Barford ..... A42B 3/326 2/424
(Continued)

FOREIGN PATENT DOCUMENTS

BE 896087 A 7/1983
DE 0476581 * 3/1992 ..... A42B 3/04
(Continued)

OTHER PUBLICATIONS

European Patent Office, Extended European Search Report, EP Patent Application 21174539.3, dated Jan. 14, 2022, 7 pages.

*Primary Examiner* — Jillian K Pierorazio
(74) *Attorney, Agent, or Firm* — Walter M. Egbert, III; Richard J. Brown; Reed Smith LLP

(57) ABSTRACT

A helmet includes a shell having an interior surface, a padding disposed along the interior surface of the shell, and a chinbar. The padding defines a first engagement surface positioned at a first lateral side of the padding and a second engagement surface positioned at an opposing second lateral side of the padding. The chinbar includes a cage, a first flange, and a second flange. The cage includes a first end defining a third engagement surface and a second end defining a fourth engagement surface. The third engagement surface interfaces with the first engagement surface and the fourth engagement surface interfaces with the second engagement surface. The first flange extends from the first end of the cage. The second flange extends from the second end of the cage. The first flange and the second flange of the chinbar are embedded within the padding.

9 Claims, 7 Drawing Sheets

Related U.S. Application Data continuation of application No. 15/147,750, filed on May 5, 2016, now Pat. No. 11,026,467.

(51) Int. Cl.

| | |
|---|---|
| ***A42B 3/32*** | (2006.01) |
| ***A42C 2/00*** | (2006.01) |
| ***A42B 3/12*** | (2006.01) |
| ***A42B 3/22*** | (2006.01) |

(56) References Cited

U.S. PATENT DOCUMENTS

| | | | | |
|---|---|---|---|---|
| 4,290,150 | A * | 9/1981 | Guerre-Berthelot | A42B 3/328 2/424 |
| 4,553,270 | A * | 11/1985 | Hoffmann | A42B 3/28 2/424 |
| 4,555,816 | A * | 12/1985 | Broersma | A42B 3/12 2/908 |
| 4,689,836 | A * | 9/1987 | Vitaloni | A42B 3/222 2/9 |
| 4,769,857 | A * | 9/1988 | Cianfanelli | A42B 3/326 2/424 |
| 4,916,759 | A * | 4/1990 | Arai | A42B 3/127 2/424 |
| 4,947,490 | A * | 8/1990 | Hayden | A42B 3/20 2/9 |
| 4,996,724 | A * | 3/1991 | Dextrase | A42B 3/32 2/425 |
| 5,044,016 | A * | 9/1991 | Coombs | A42B 3/10 2/5 |
| 5,619,755 | A * | 4/1997 | Casartelli | A42B 3/326 2/424 |
| 5,619,756 | A * | 4/1997 | Garneau | A42B 3/066 2/425 |
| 6,282,726 | B1 * | 9/2001 | Noyerie | A42B 3/225 2/424 |
| 6,289,521 | B1 * | 9/2001 | Ikeda | A42B 3/105 2/424 |
| 6,711,751 | B1 * | 3/2004 | Muskovitz | A42B 3/12 2/10 |
| 6,804,829 | B2 * | 10/2004 | Crye | A42B 3/12 2/9 |
| 6,978,477 | B2 | 12/2005 | Foote | |
| 6,983,488 | B2 * | 1/2006 | Foote | A42B 3/003 2/9 |
| D556,386 | S | 11/2007 | Lee | |
| D583,102 | S * | 12/2008 | Summers | D29/106 |
| 7,854,023 | B2 * | 12/2010 | Ando | A42B 3/328 2/424 |
| 7,987,525 | B2 * | 8/2011 | Summers | A42B 3/281 2/410 |
| 8,225,431 | B2 * | 7/2012 | Cyr | A42B 3/22 2/6.3 |
| 8,327,465 | B2 * | 12/2012 | Arai | A42B 3/0473 2/415 |
| D680,694 | S | 4/2013 | Hwang | |
| 8,671,467 | B2 * | 3/2014 | Tack | A42B 3/04 2/6.2 |
| 8,959,668 | B1 * | 2/2015 | Ganes | A42B 3/205 2/9 |
| 9,060,557 | B2 * | 6/2015 | Maier | A42B 3/04 |
| 9,511,272 | B2 * | 12/2016 | Lowe | A42B 3/18 |
| 10,492,559 | B1 | 12/2019 | Kele et al. | |
| 10,918,153 | B2 * | 2/2021 | Kele | A42B 3/283 |
| 11,026,467 | B2 | 6/2021 | Durham et al. | |
| 11,337,482 | B2 * | 5/2022 | Tan | A42B 3/32 |
| 2003/0070200 | A1 * | 4/2003 | Crye | A42B 3/10 2/6.6 |
| 2004/0049825 | A1 | 3/2004 | DeHaan et al. | |
| 2005/0015861 | A1 * | 1/2005 | Gafforio | A42B 3/326 2/424 |
| 2005/0278833 | A1 * | 12/2005 | Pierce | A42B 3/281 2/424 |
| 2006/0064799 | A1 | 3/2006 | Dion | |
| 2006/0143807 | A1 * | 7/2006 | Udelhofen | A42B 3/16 2/425 |
| 2006/0272067 | A1 * | 12/2006 | Gagnon | A41D 13/11 2/9 |
| 2007/0083967 | A1 * | 4/2007 | Crossman | A42B 3/326 2/15 |
| 2008/0115260 | A1 * | 5/2008 | Schulz | A42B 3/061 2/427 |
| 2008/0127400 | A1 * | 6/2008 | Dupuis | F41H 1/02 2/9 |
| 2008/0250549 | A1 * | 10/2008 | Summers | A42B 3/281 2/425 |
| 2009/0031479 | A1 * | 2/2009 | Rush, III | A63B 71/10 2/9 |
| 2009/0044316 | A1 * | 2/2009 | Udelhofen | A63B 71/10 2/9 |
| 2009/0178184 | A1 * | 7/2009 | Brine, III | A42B 3/00 2/424 |
| 2010/0229271 | A1 * | 9/2010 | Marissen | A42B 3/062 2/2.5 |
| 2010/0281603 | A1 * | 11/2010 | Ho | A42B 3/08 2/421 |
| 2011/0072547 | A1 * | 3/2011 | Doria | A42B 3/08 2/2.5 |
| 2011/0088147 | A1 * | 4/2011 | Arai | A42B 3/127 2/421 |
| 2012/0066818 | A1 * | 3/2012 | Pierini | A42B 3/326 2/424 |
| 2012/0073034 | A1 * | 3/2012 | Gafforio | A42B 3/127 2/414 |
| 2012/0284905 | A1 * | 11/2012 | Kim | A42B 3/226 2/424 |
| 2012/0291183 | A1 * | 11/2012 | Janisse | A42B 3/0473 2/411 |
| 2013/0276214 | A1 * | 10/2013 | Wesson | A42B 3/125 2/414 |
| 2014/0007328 | A1 * | 1/2014 | Brine, III | A42B 3/125 2/424 |
| 2014/0090155 | A1 * | 4/2014 | Johnston | A42B 3/127 2/414 |
| 2014/0143937 | A1 * | 5/2014 | Cram | A42B 3/32 2/410 |
| 2014/0196198 | A1 * | 7/2014 | Cohen | A42B 3/063 2/414 |
| 2014/0338106 | A1 * | 11/2014 | Zanchi | A42B 3/08 2/421 |
| 2014/0373257 | A1 * | 12/2014 | Turner | A42B 1/0183 2/414 |
| 2015/0026858 | A1 | 1/2015 | Ross et al. | |
| 2015/0250255 | A1 * | 9/2015 | Ellison | A42B 3/326 2/425 |
| 2016/0038821 | A1 * | 2/2016 | Mackey | A43B 5/1666 2/463 |
| 2016/0095375 | A1 * | 4/2016 | Ho | A42C 2/002 2/411 |
| 2016/0198787 | A1 * | 7/2016 | Kele | A42B 3/16 2/414 |
| 2016/0302496 | A1 * | 10/2016 | Ferrara | A41D 13/0007 |
| 2016/0327373 | A1 * | 11/2016 | Noordzij | F41H 1/08 |
| 2017/0112227 | A1 * | 4/2017 | Pietrzak | A42B 3/205 |
| 2017/0164679 | A1 * | 6/2017 | Schmitter | A42B 3/326 |
| 2017/0265557 | A1 * | 9/2017 | Mercado, Jr. | A42B 3/00 |
| 2021/0361019 | A1 | 11/2021 | Durham et al. | |

FOREIGN PATENT DOCUMENTS

| | | | |
|---|---|---|---|
| EP | 0476591 | A2 | 3/1992 |
| WO | 2013186190 | A1 | 12/2013 |
| WO | 2016000687 | A1 | 1/2016 |

* cited by examiner

IN-MOLDED HELMET CHINBAR

CROSS-REFERENCE TO RELATED APPLICATIONS

This application is a continuation of U.S. patent application Ser. No. 17/307,847, filed May 4, 2021, and titled IN-MOLDED HELMET CHINBAR, which is a continuation of U.S. patent application Ser. No. 15/147,750, filed May 5, 2016, and titled IN-MOLDED HELMET CHINBAR, both of which are incorporated herein in their entirety by reference thereto.

BACKGROUND

The subject matter disclosed herein relates to an in-molded helmet chinbar for a protective helmet, such as helmets used in motocross, other motorsports or protective helmets such as being used in downhill bicycling sports.

Protective helmets are frequently used for recreational and vocational activities and sports. For example, protective helmets are used as head protection in motorsports, by jockeys in horse racing, in American football, ice hockey games, cricket games, and during rock climbing. Protective helmets are also used when performing dangerous work activities, such as hard hats used in construction work, during mining activities, and by police agents. Protective helmets are often required to be worn in transportation, for example motorcycle helmets and bicycle helmets.

SUMMARY

The subject matter disclosed herein offers solutions for problems resulting from unitary construction of a chinbar and helmet.

One embodiment relates to a helmet. The helmet includes a shell, a padding, and a chinbar. The shell has an exterior surface and an interior surface. The padding is disposed along the interior surface of the shell. The padding defines a first engagement surface positioned at a first lateral side of the padding and a second engagement surface positioned at an opposing second lateral side of the padding. The chinbar includes a cage, a first flange, and a second flange. The cage is configured to extend around a chin of a wearer of the helmet. The cage includes a first end defining a third engagement surface and a second end defining a fourth engagement surface. The third engagement surface of the chinbar interfaces with the first engagement surface of the padding and the fourth engagement surface of the chinbar interfaces with the second engagement surface of the padding. The first flange extends from the first end of the cage. The second flange extends from the second end of the cage. The first flange of the chinbar is embedded within the first lateral side of the padding and the second flange of the chinbar is embedded within the opposing second lateral side of the padding.

Another embodiment relates to a helmet chinbar. The helmet chinbar includes a cage, a first attachment member, and a second attachment member. The cage is configured to extend around a chin of a wearer of a helmet. The cage includes a first attachment end and a second attachment end. The first attachment member includes a first plate that extends from the first attachment end of the cage. The second attachment member includes a second plate that extends from the second attachment end of the cage. The first plate and the second plate of the helmet chinbar are configured to embed within a padding of the helmet to attach the cage to the helmet. The first plate and the second plate increase in at least one of height and thickness along a length thereof.

Yet another embodiment relates to a helmet. The helmet includes a shell, a padding, and a chinbar. The shell has an exterior surface and an interior surface. The padding is disposed along the interior surface of the shell. The chinbar includes a cage, a first attachment member, and a second attachment member. The cage is configured to extend around a chin of a wearer of the helmet. The cage includes a first attachment end and a second attachment end. The first attachment member extends from the first attachment end of the cage. The second attachment member extends from the second attachment end of the cage. The first attachment member and the second attachment member of the chinbar are embedded within the padding.

Still another embodiment relates to a method of manufacturing a helmet. The method includes forming a chinbar of the helmet in a first forming operation, the chinbar including a pair of flanges; forming a shell of the helmet in a second forming operation; coupling the chinbar to the helmet shell such that the pair of flanges extend within an internal cavity of the helmet shell; and in-molding a padding layer into the internal cavity of the helmet shell such that the pair of flanges of the chinbar become embedded within the padding layer.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The drawings are provided to illustrate example embodiments described herein and are not intended to limit the scope of the disclosure. Throughout the drawings, reference numbers may be re-used to indicate general correspondence between referenced elements.

DETAILED DESCRIPTION

Figure 1:
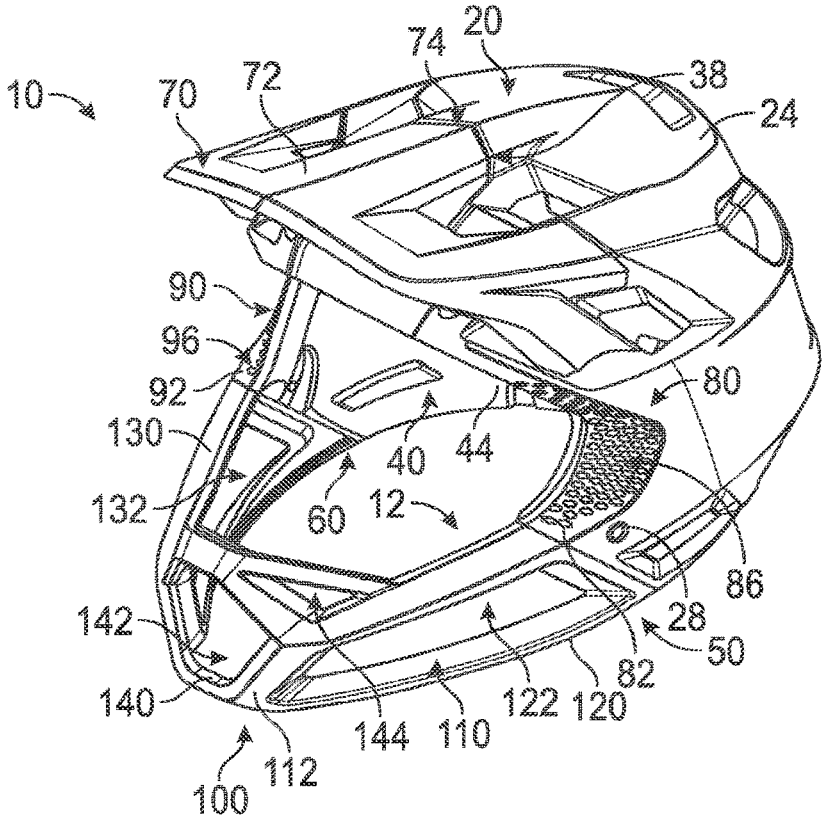
FIG. 1 is a front perspective view of a helmet including a chinbar, according to an exemplary embodiment.

Various aspects of the disclosure will now be described with regard to certain examples and embodiments, which are intended to illustrate but not to limit the disclosure. Nothing in this disclosure is intended to imply that any particular feature or characteristic of the disclosed embodiments is essential. The scope of protection is defined by the claims that follow this description and not by any particular embodiment described herein. Before turning to the figures, which illustrate example embodiments in detail, it should be understood that the application is not limited to the details or methodology set forth in the description or illustrated in the figures. It should also be understood that the terminology is for the purpose of description only and should not be regarded as limiting.

Embodiments herein generally relate to an in-molded or co-molded helmet chinbar. Such an in-molded helmet chinbar may be used in a number of activities, including without limitation: sports and athletics, including extreme sports such as motocross, snowmobiling, snowboarding, skiing, skateboarding, etc., and traditional sports such as football, hockey, baseball, lacrosse, etc.; cycling activities, including auto racing, motorcycle riding and racing, BMX, mountain biking, downhill biking, etc.; with recreational vehicles including all-terrain vehicles (ATVs), utility task vehicles (UTVs), dirt bikes, snowmobiles, and other off-road vehicles; military and/or construction applications; to name just a few. Further details are provided herein.

Typical helmet construction consists of a shell having a generally dome-shape structure which covers most of the user's head and having a view area or opening at the front. Helmets often include a chinbar to protect a wearer of a helmet during impacts to the face and/or head. Chinbars are traditionally integrally formed with a shell of the helmet (e.g., a unitary construction). Such a unitary construction may lead to several disadvantages including increasing the overall weight of the helmet, preventing the implementation of chinbar ventilation, and reducing impact absorption performance.

According an exemplary embodiment, a helmet (e.g., a full-face helmet, etc.) includes a shell, a padding, and a chinbar. The chinbar may be manufactured from a first material (e.g., Kevlar, carbon fiber, aramid fiber, fiberglass, polycarbonate, acrylonitrile butadiene styrene (ABS), etc.). The shell may be manufactured from a second material (e.g., Kevlar, carbon fiber, aramid fiber, fiberglass, polycarbonate, ABS, etc.). The padding may be manufactured from a third material (e.g., a compressible, impact attenuating polymeric material, etc.). The padding is configured to be received within an interior of the helmet and conform to the head of a wearer of the helmet. The chinbar may include a cage, a first attachment member, and a second attachment member. The cage is configured to extend around a chin of a wearer of the helmet. According to an exemplary embodiment, the chinbar is an individual, unitary component of the helmet (e.g., the chinbar is not integrally formed with the shell, etc.). The first attachment member and the second attachment member of the chinbar are configured to be embedded within the padding to attach the cage to the helmet (e.g., the chinbar is in-molded or co-molded within the padding of the helmet, etc.), according to an exemplary embodiment. In some embodiments, the cage defines a plurality of apertures forming open space within the cage, thereby reducing an overall weight of the helmet and increasing ventilation through the chinbar and into the internal cavity of the helmet. The exemplary helmet including the in-molded chinbar of the present disclosure provides various advantages over other designs, such as a traditional helmet including a unitary shell and chinbar structure. The advantages may include, but are not limited to, reducing the overall weight of the helmet and/or chinbar (e.g., facilitating a lightweight construction, etc.), and increasing ventilation, while still satisfying various helmet impact standards (e.g., ASTM F1952, etc.).

According to the exemplary embodiment shown in FIGS. 1-13, a protective headwear (e.g., a full-face helmet, etc.), shown as helmet 10, includes a face guard (e.g., face shield, wrap-around chinbar, face mask, visor, etc.), shown as chinbar 100. According to an exemplary embodiment, the helmet 10 is a motocross helmet. In other embodiments, the helmet 10 is a snowmobile helmet, a snowboarding or skiing helmet, a bicycling helmet, a mountain biking helmet, a motorcycle helmet, a skateboarding helmet, or still another action or extreme sports helmet. In still other embodiments, the helmet 10 is a football helmet, a hockey helmet, a lacrosse helmet, a baseball helmet, or still another sports helmet. In yet other embodiments, the helmet 10 is a military helmet, a construction helmet, or still another helmet used to protect a wearer of the helmet 10 from impacts to his or her head. The size of the helmet 10 and/or an interior, shown as internal cavity 12, of the helmet 10 may be varied to fit various wearers (i.e., different head sizes).

Figure 10:
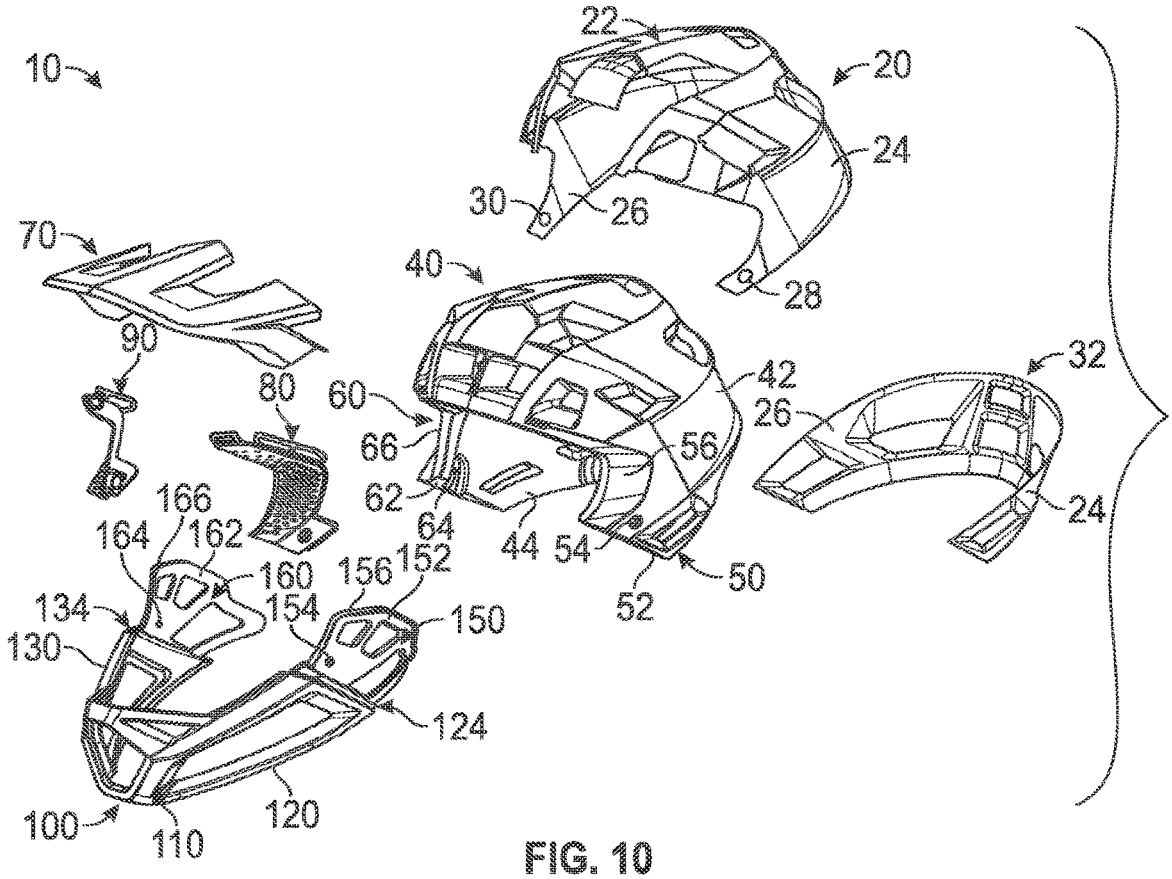
FIGS. 10-13 are various perspective exploded views of the helmet of FIG. 1 illustrating a method for assembling the helmet, according to an exemplary embodiment.
Figure 11:
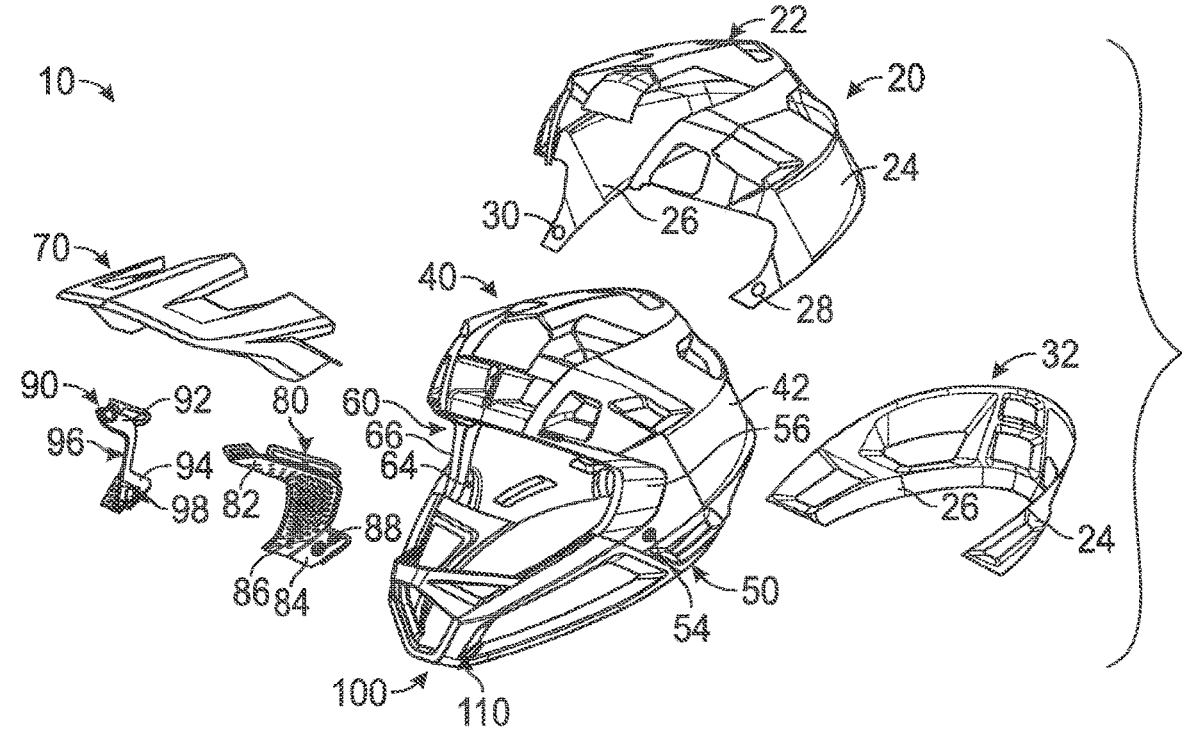
Figure 12:
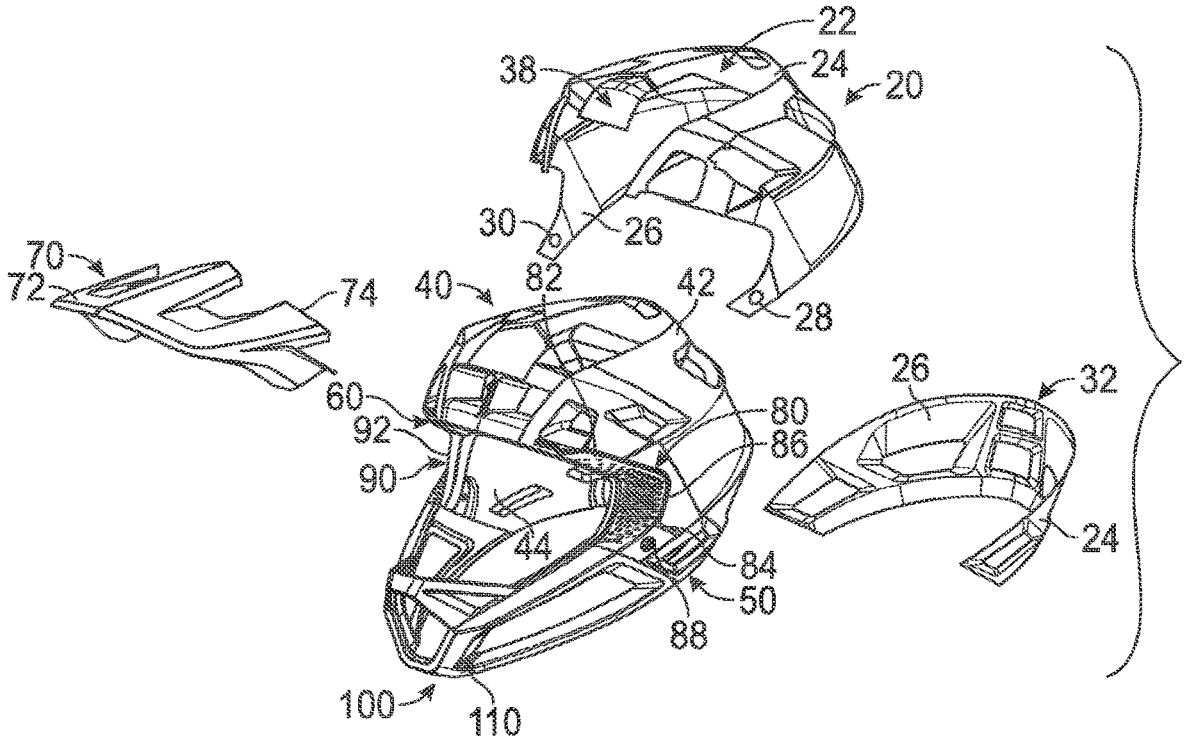

As shown in FIGS. 1-4 and 10-13, the helmet 10 includes an outer casing or shell, shown as helmet shell 20, a padding layer, shown as padding 40, a frontal extension, shown as visor 70, a first vent cover, shown as right vent cap 80, and a left vent cover, shown as left vent cap 90. As shown in FIGS. 1-2, 4, and 10-13, the helmet shell 20 has a first surface, shown as exterior surface 24, and an opposing second surface, shown as interior surface 26. According to an exemplary embodiment, the helmet shell 20 includes a strong, rigid layer configured to provide abrasion resistance and protection from foreign object penetration. For example, the helmet shell 20 may be manufactured from, but is not limited to, a lightweight plastic, a plastic composite, Kevlar, carbon fiber, aramid fiber, fiberglass, polycarbonate, and/or ABS, among other possible materials. In some embodiments, the helmet shell 20 is configured to disperse an impact force experienced by the exterior surface 24 of the helmet 10 over a greater area of the helmet shell 20 and the padding 40. As shown in FIGS. 10-12, the helmet shell 20 is configured as a two piece shell, including a first portion, shown as upper shell portion 22, and a second portion, shown as lower portion 32. In other embodiments, the helmet shell 20 is configured as single, unitary shell.

As shown in FIGS. 1-2, 4, and 10, the padding 40 has a first surface, shown as outer surface 42, and an opposing second surface, shown as inner surface 44. According to an exemplar embodiment, the outer surface 42 of the padding 40 is configured to conform to and be disposed along the interior surface 26 of the helmet shell 20 and the inner surface 44 of the padding 40 is configured to conform to a head of a wearer of the helmet 10. The padding 40 is manufactured from a compressible, impact attenuating material, according to an exemplary embodiment. For example, the padding 40 may be manufactured from, but is not limited to, expanded polystyrene (EPS) foam, expanded polypropylene (EPP) foam, expanded polyethylene (EYE)

foam, polyolefin foam, polyurethane foam, and/or still another impact attenuating or absorbing material.

Figure 4:
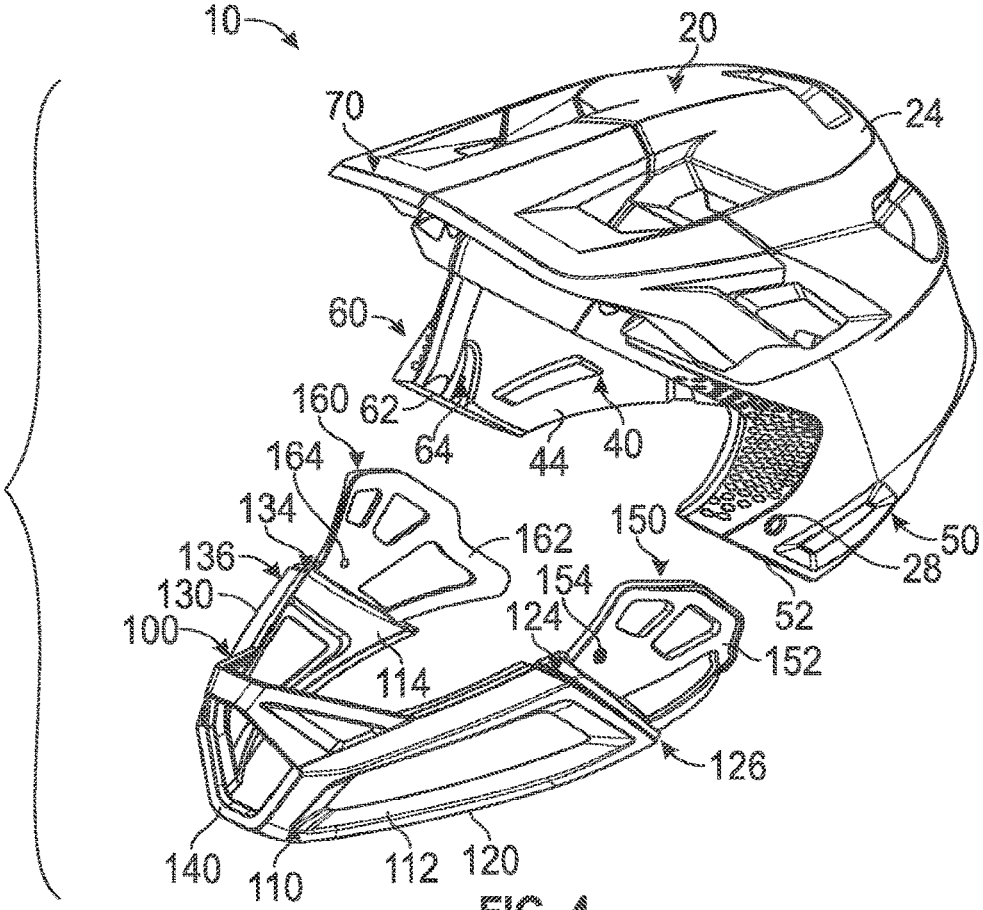
FIG. 4 is a front perspective exploded view of the helmet and the chinbar of FIG. 1, according to an exemplary embodiment.
Figure 7:
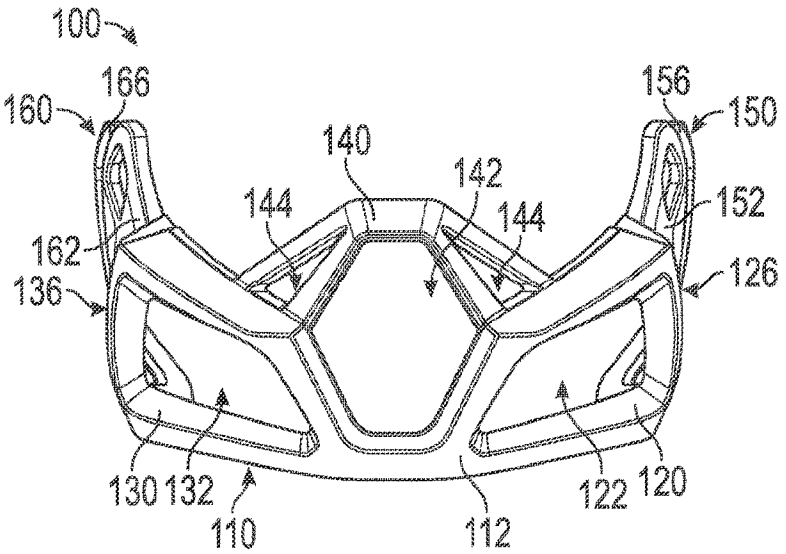
FIG. 7 is a front plan view of the chinbar of FIG. 5, according to an exemplary embodiment.
Figure 8:
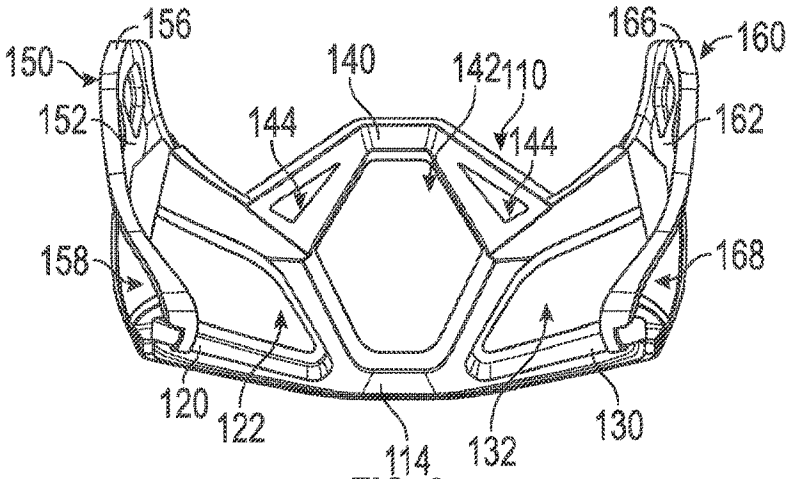
FIG. 8 is a rear plan view of the chinbar of FIG. 5, according to an exemplary embodiment.

As shown in FIGS. 4 and 10-12, the padding 40 has a first lateral side, shown as right side 50, and an opposing second lateral side, shown as left side 60. As shown in FIGS. 4 and 10, the right side 50 of the padding 40 defines a first interface, shown as right chinbar engagement surface 52, and the left side 60 of the padding 40 defines a second interface, shown as left chinbar engagement surface 62. As shown in FIGS. 10-11, the right side 50 of the padding 40 defines an aperture, shown as right aperture 54. As shown in FIGS. 4 and 10-11, the left side 60 of the padding 40 defines an aperture, shown as left aperture 64. As shown in FIGS. 1-2, 4, and 10-13, the helmet shell 20 defines a corresponding number of apertures, shown as tight aperture 28 and left aperture 30. According to an exemplary embodiment, the right aperture 28 and the left aperture 30 of the helmet shell 20 are positioned to correspond with (e.g., the size of, the position of, etc.) the right aperture 54 and the left aperture 64 of the padding 40, respectively, to facilitate coupling the helmet shell 20 to the padding 40 (e.g., with fasteners, etc.). As shown in FIGS. 11-12, the right side 50 of the padding 40 defines a third interface, shown a right vent engagement surface 56, and the left side 60 of the padding 40 defines a fourth interface, shown as Left vent engagement surface 66. The helmet 10 may be capable of experiencing a plurality of impacts (e.g., two or more, etc.) without having to be replaced. Thus, the padding 40 may include a material configured to survive two or more impacts.

In one embodiment, the padding 40 is configured as a multi-layer padding (e.g., has two or more layers, etc.). The layers of the padding 40 may be configured to cooperatively provide impact resistance to mitigate (e.g., reduce, lessen, absorb, dissipate, attenuate, etc.) an impact force experienced by the exterior surface 24 of the helmet shell 20 as the impact force propagates through the multiple layers of the padding 40. By way of example, the padding 40 may include a first, outer layer (e.g., disposed along the interior surface 26 of the helmet shell 20, etc.) and a second, inner layer (e.g., configured to conform to the head of a wearer of the helmet 10, etc.). In one embodiment, the outer layer and the inner layer are manufactured from the same material. In other embodiments, the outer layer is manufactured from a first material and the inner layer is manufactured from a second, different material. In some embodiments, the outer layer has a first density and the inner layer has a second, different density. In one embodiment, the first density of the outer layer is relatively greater (e.g., more dense, etc.) than the second density of the inner layer. In other embodiments, the first density of the outer layer is relatively equal to or less than the second density of the inner layer. In some embodiments, the outer layer and the inner layer defines interlocking profiles that facilitate progressive (e.g., analog, etc.) impact resistance. The interlocking profiles may include continuous and/or discrete protrusions (e.g., continuous wedges, conical protrusions, etc.) that interface with one another.

Figure 14:
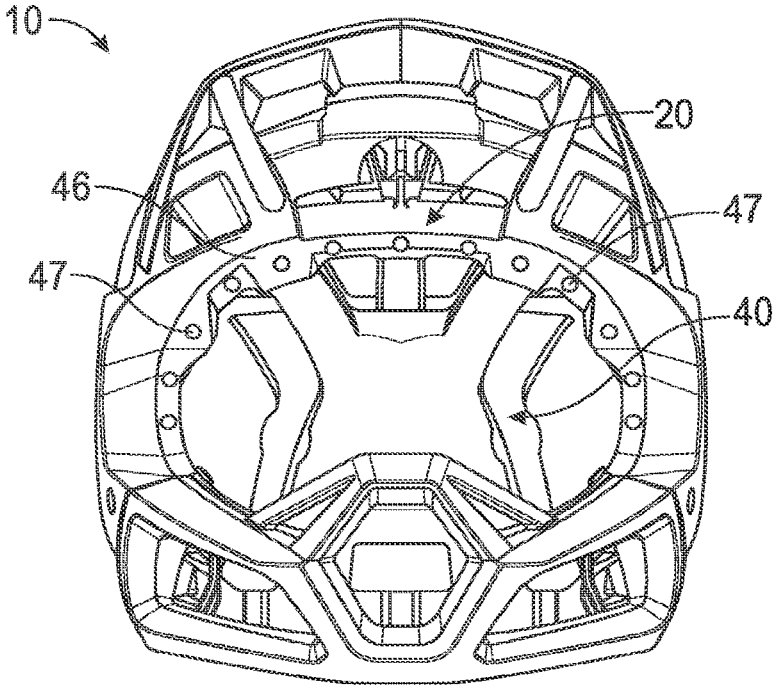
FIGS. 14-15 are various views of a helmet having reinforcement members, according to an exemplary embodiment.
Figure 15:
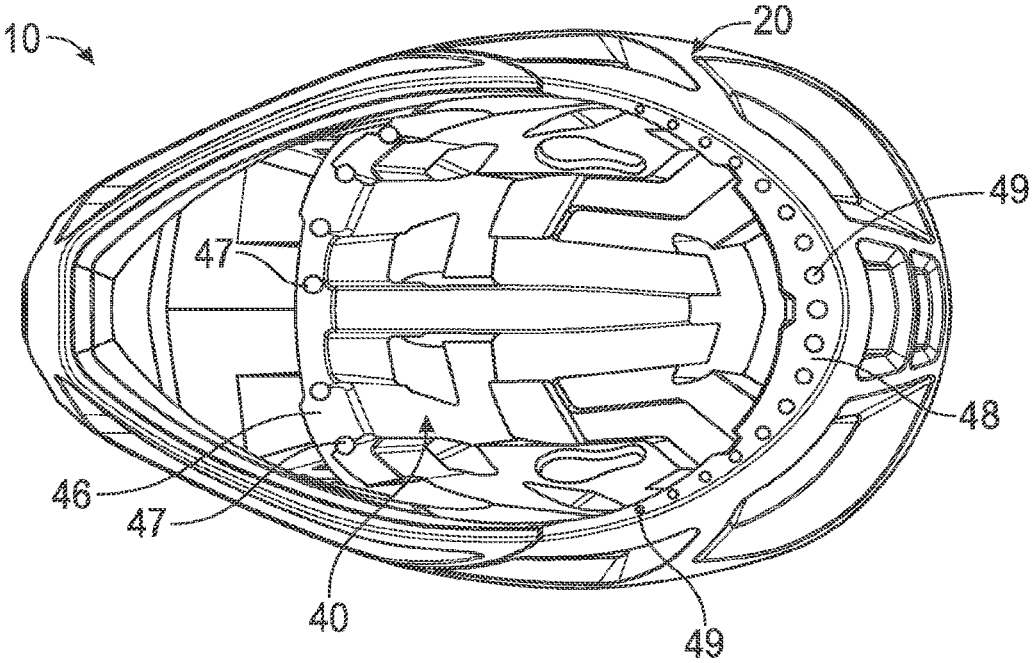

In some embodiments, the padding 40 and/or the helmet shell 20 include reinforcement members (e.g., titanium reinforcement members, titanium rings, etc.) positioned around the periphery of the internal cavity 12 or portions thereof. As shown in FIG. 14, the helmet 10 includes first reinforcement members, shown as reinforcement members 47, positioned around the periphery of the eye/face opening of the internal cavity 12, defined by a front edge, shown as front edge 46. As shown in FIG. 15, the helmet 10 includes second reinforcement members, shown as reinforcement members 49, positioned around the periphery of the neck opening of the internal cavity 12, defined by a bottom edge, shown as bottom edge 48, In some embodiments, the reinforcement members 47 and/or the reinforcement members 49 form a continuous ring/member that extends at least partially around a portion of the front edge 46 and/or the bottom edge 48, respectively. In some embodiments, the reinforcement members 47 and/or the reinforcement members 49 are not included in the helmet 10.

As shown in FIGS. 1-2 and 12-13, the visor 70 includes a projection, shown as bill 72, and an engagement surface, shown as rear surface 74. The rear surface 74 of the visor 70 is shaped to correspond with (e.g., complement, etc.) an engagement surface, shown as upper, front surface 38 of the helmet shell 20. According to an exemplary embodiment, the visor 70 is coupled to the upper, front surface 38 of the helmet shell 20 such that the bill 72 of the visor 70 projects from the helmet shell 20 over the internal cavity 12 of the helmet 10. The visor 70 may be configured to shield a wearer's eyes from the sun and/or from incoming debris (e.g., rocks, dirt, mud, etc.).

In some embodiments, the visor 70 is pivotally coupled to the upper, front surface 38 of the helmet 10. For example, the visor 70 may pivot around the sides of the helmet 10 at an angle relative to a horizontal plane. The angle may range, for example, anywhere between −90 degrees to +270 degrees relative to the horizontal plane of the helmet 10. In some embodiments, the visor 70 may be adjustable within a limited range, for example, ranging between −45 and +45 degrees relative to the horizontal plane. In some embodiments, the visor 70 is coupled to the helmet shell 20 with at least one of a breakaway connection and a toolless, pivotable connection. By way of example, the visor 70 may be coupled to the helmet shell 20 with one or more coupling elements (e.g., magnets, hook and loop fasteners, clips, etc.) that allow the visor 70 to decouple (e.g., break-away, etc.) from the helmet shell 20 during an impact to the visor 70 (e.g., during a crash, etc.). In some embodiments, the visor 70 is manufactured from an elastic and/or soft material that allows the visor 70 to deform during an impact to the visor 70 (e.g., during a crash, etc.). In another embodiment, the visor 70 is integrally formed with the helmet shell 20. In other embodiments, the helmet 10 does not include the visor 70.

As shown in FIGS. 1-2 and 11-12, the right vent cap 80 includes an first plate, shown as engagement plate 82, and a second plate, shown as attachment plate 84, extending from the engagement plate 82. As shown in FIGS. 11-12, the engagement plate 82 is shaped to correspond with the right vent engagement surface 56 of the padding 40 and the attachment plate 84 is shaped to correspond with the right side 50 of the padding 40. As shown in FIGS. 1-2 and 11-12, the engagement plate 82 of the right vent cap 80 defines a plurality of apertures, shown as vent holes 86. According to an exemplary embodiment, the vent holes 86 allow air to flow into the padding 40 for cooling and/or aerodynamic purposes. In other embodiments, the vent holes 86 are replaced with dimples to improve the aesthetic appeal of the helmet 10. As shown in FIGS. 11-12, the attachment plate 84 defines an aperture, shown as right aperture 88. According to an exemplary embodiment, the right aperture 88 is positioned to correspond with (e.g., the size of, the position of, etc.) the right aperture 54 of the padding 40 and the right aperture 28 of the helmet shell 20 to facilitate coupling the right vent cap 80 to the padding 40 such that the attachment plate 84 of the right vent cap 80 is positioned between the right side 50 of the padding 40 and the helmet shell 20, In some embodiments, the helmet 10 does not include the right vent cap 80.

Figure 2:
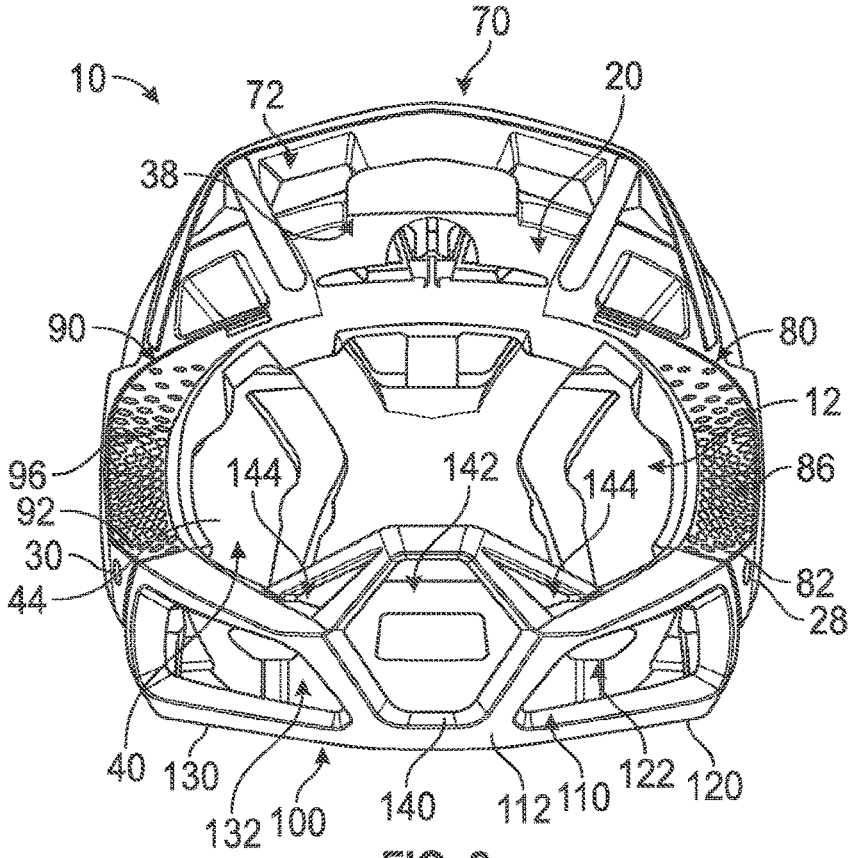
FIG. 2 is a front plan view of the helmet of FIG. 1, according to an exemplary embodiment.

As shown in FIGS. 1-2 and 11-12, the left vent cap 90 includes an first plate, shown as engagement plate 92, and a second plate, shown as attachment plate 94, extending from the engagement plate 92. As shown in FIGS. 11-12, the engagement plate 92 is shaped to correspond with the left vent engagement surface 66 of the padding 40 and the attachment plate 94 is shaped to correspond with the left side 60 of the padding 40. As shown in FIGS. 1-2 and 11, the engagement plate 92 of the left vent cap 90 defines a plurality of apertures, shown as vent holes 96. According to an exemplary embodiment, the vent holes 96 allow air to flow into the padding 40 for cooling and/or aerodynamic purposes. In other embodiments, the vent holes 86 are replaced with dimples to improve the aesthetic appeal of the helmet 10. As shown in FIG. 11, the attachment plate 94 defines an aperture, shown as left aperture 98. According to an exemplary embodiment, the left aperture 98 is positioned to correspond with (e.g., the size of, the position of, etc.) the left aperture 64 of the padding 40 and the left aperture 30 of the helmet shell 20 to facilitate coupling the left vent cap 90 to the padding 40 such that the attachment plate 94 of the left vent cap 90 is positioned between the left side 60 of the padding 40 and the helmet shell 20. In some embodiments, the helmet 10 does not include the left vent cap 90.

Figure 3:
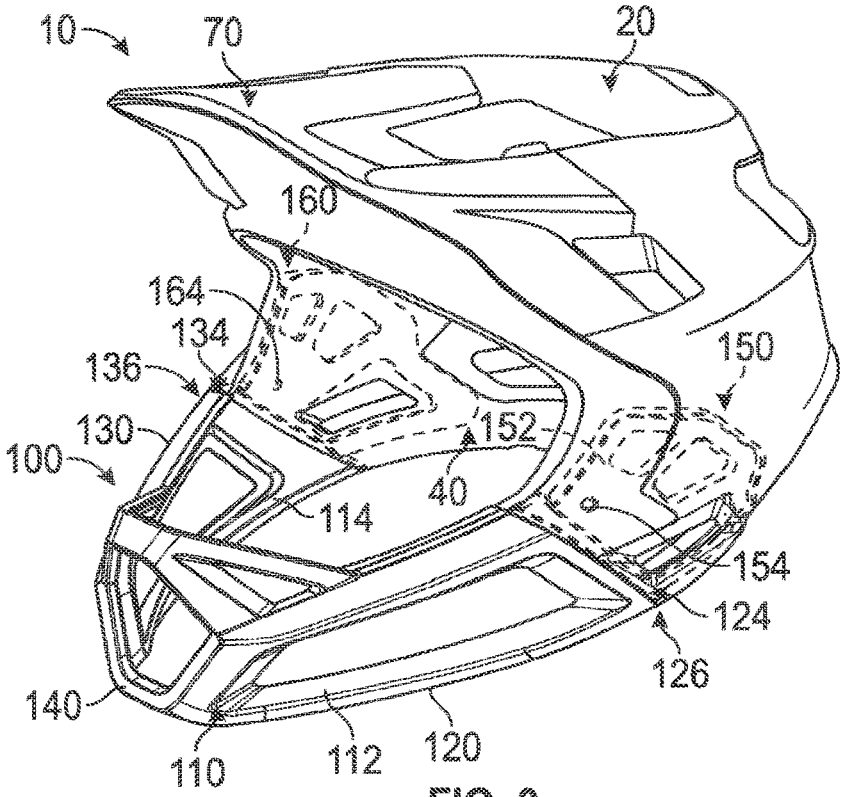
FIG. 3 is a front perspective view of the chinbar in-molded within the helmet of FIG. 1, according to an exemplary embodiment.
Figure 9A:
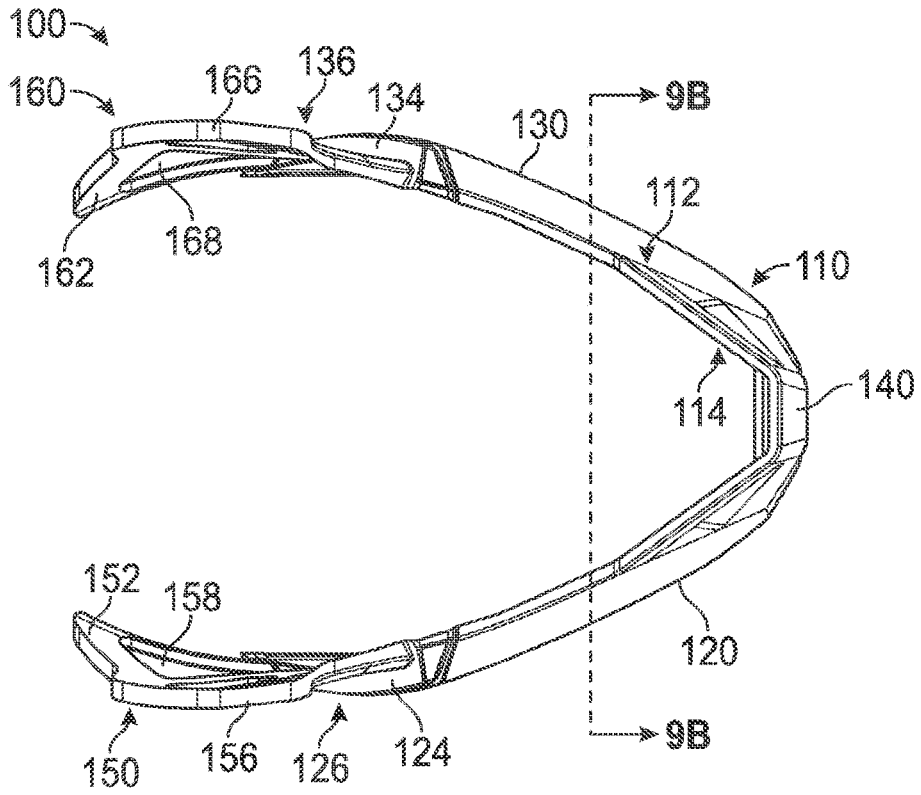
FIG. 9A is a bottom plan view of the chinbar of FIG. 5, according to an exemplary embodiment.
Figure 9B:
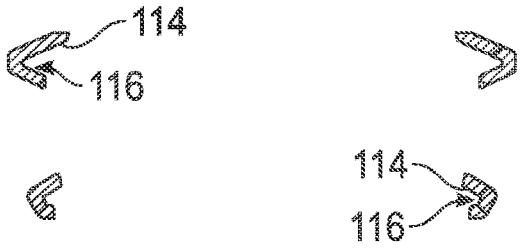
FIG. 9B is a cross-sectional view of the chinbar of FIG. 9A, according to an exemplary embodiment.

According to an exemplary embodiment, the chinbar 100 is an individual, unitary component of the helmet 10. As shown in FIGS. 1-13, the chinbar 100 includes an elongated bar, shown as cage 110, having a first side, shown as exterior 112, and an opposing second side, shown as interior 114. As shown in FIG. 9B, the interior 114 of the cage 110 defines an interior cavity, shown as C-channel 116. In some embodiments, the C-channel 116 of the interior 114 is configured to receive and be lined with padding similar to the padding 40 disposed with the helmet shell 20 (e.g., expanded polystyrene (EPS) foam, expanded polypropylene (EPP) foam, expanded polyethylene (EPE) foam, polyolefin foam, polyurethane foam, etc.). As shown in FIGS. 1-3, the cage 110 extends from the right side 50 to the left side 60, around and partially enclosing the internal cavity 12 of the helmet 10 (e.g., around a chin and lower face of a wearer of the helmet 10, etc.). The cage 110 may be positioned to protect a wearer's face during a crash or collision (e.g., when falling face first, etc.) and/or from debris (e.g., mud, rocks, dirt, etc.).

According to an exemplary embodiment, the chinbar 100 is configured to protect a wearer's face (e.g., from debris, during an impact, etc.) and/or mitigate at least a portion of impact energy experienced by the chinbar 100 during an impact thereto. In some embodiments, the chinbar 100 is configured to deform to absorb such impact energy and then return to its original shape (e.g., elastic behavior, including a resilient material such as polycarbonate, etc.). In some embodiments, the chinbar 100 is configured to deform to absorb such impact energy and then shatter at some point (e.g., an impact threshold, a deformation threshold, plastic behavior, including a stiff material such as carbon fiber, etc.).

As shown in FIGS. 1-9A, the cage 110 includes a first portion, shown as right portion 120, a second portion, shown as left portion 130, and a third portion, shown as central portion 140. As shown in FIGS. 3-9A, the right portion 120 of the cage 110 includes a first end, shown as right end 126. The right end 126 defines a first interface, shown as tight padding engagement surface 124, and includes a first attachment member, shown as right flange 150, extending therefrom. As shown in FIGS. 3-4 and 10-11, the right padding engagement surface 124 of the right portion 120 of the cage 110 interfaces with the right chinbar engagement surface 52 of the padding 40 such that the right flange 150 is embedded (e.g., nested, in-molded, co-molded, disposed, inserted, etc.) within the right side 50 of the padding 40. As shown in FIGS. 3-9A and 10, the right flange 150 includes a right plate, shown as right extension plate 152, that defines an aperture, shown as right aperture 154, According to an exemplary embodiment, the right aperture 154 is positioned to correspond with (e.g., the size of, the position of, etc.) the right aperture 54 of the padding 40, the right aperture 28 of the helmet shell 20, and/or the right aperture 88 of the right vent cap 80 to facilitate coupling the right portion 120 of the cage 110 to the other components of the helmet 10. By way of example, the right apertures 28, 54, 88, and/or 154 may receive a first fastener (e.g., a bolt, a screw, a rivet, etc.), thereby securing the right portion 120 of the cage 110, the helmet shell 20, and/or the right vent cap 80 to the right side 50 of the padding 40.

As shown in FIGS. 3-9A, the left portion 130 of the cage 110 includes a second end, shown as left end 136. The left end 136 defines a second interface, shown as left padding engagement surface 134, and includes a second attachment member, shown as left flange 160, extending therefrom. As shown in FIGS. 3-4 and 10-11, the left padding engagement surface 134 of the left portion 130 of the cage 110 interfaces with the left chinbar engagement surface 62 of the padding 40 such that the left flange 160 is embedded (e.g., nested, in-molded, co-molded, disposed, inserted, etc.) within the left side 60 of the padding 40. As shown in FIGS. 3-9A and 10, the left flange 160 includes a left plate, shown as left extension plate 162, that defines an aperture, shown as left aperture 164. According to an exemplary embodiment, the left aperture 164 is positioned to correspond with (e.g., the size of, the position of, etc.) the left aperture 64 of the padding 40, the left aperture 30 of the helmet shell 20, and/or the left aperture 98 of the left vent cap 90 to facilitate coupling the left portion 130 of the cage 110 to the other components of the helmet 10. By way of example, the left apertures 30, 64, 98, and/or 164 may receive a second fastener (e.g., a bolt, a screw, a rivet, etc.), thereby securing the left portion 130 of the cage 110, the helmet shell 20, and/or the left vent cap 90 to the left side 60 of the padding 40. In some embodiments, the chinbar 100 is selectively releasable (e.g., detachable, etc.) from the helmet 10 (e.g., the right flange 150 and the left flange 160 are slidably received within corresponding recesses of the padding 40 and may disengage therefrom, etc.). In some embodiments, the chinbar 100 is integrally formed with or rigidly attached (e.g., fixed, etc.) to at least one of the helmet shell 20 and the padding 40.

According to the exemplary embodiment shown in FIGS. 3-9A and 10, the right flange 150 and the left flange 160 expand and/or taper outward along the lengths thereof (e.g., narrowest near the right padding engagement surface 124 and the left padding engagement surface 134, respectively; the right flange 150 and the left flange 160 increase in width, height, and/or thickness the further each extends into the padding 40; the right flange 150 and the left flange 160 form the broadest portion of the chinbar 100; etc.). Such tapering and/or expansion of the right flange 150 and the left flange 160 within the padding 40 may aid in preventing detachment of the chinbar 100 from the helmet 10 and/or increasing load distribution through the helmet 10 (e.g., during an impact to the chinbar 100, etc.) when the right flange 150 and the left flange 160 are embedded within the padding 40. As shown in FIGS. 5-9A and 10, the right flange 150 includes a rim, shown as lip 156, that extends around the periphery of the right extension plate 152. As shown in FIGS. 5,7-9A, and 10, the left flange 160 includes a rim, shown as lip 166, that extends around the periphery of the left extension plate 162. The lip 156 and/or the lip 166 may further aid in preventing detachment of the chinbar 100 from the helmet 10 when the right flange 150 and the left flange 160 are embedded within the padding 40.

Figure 5:
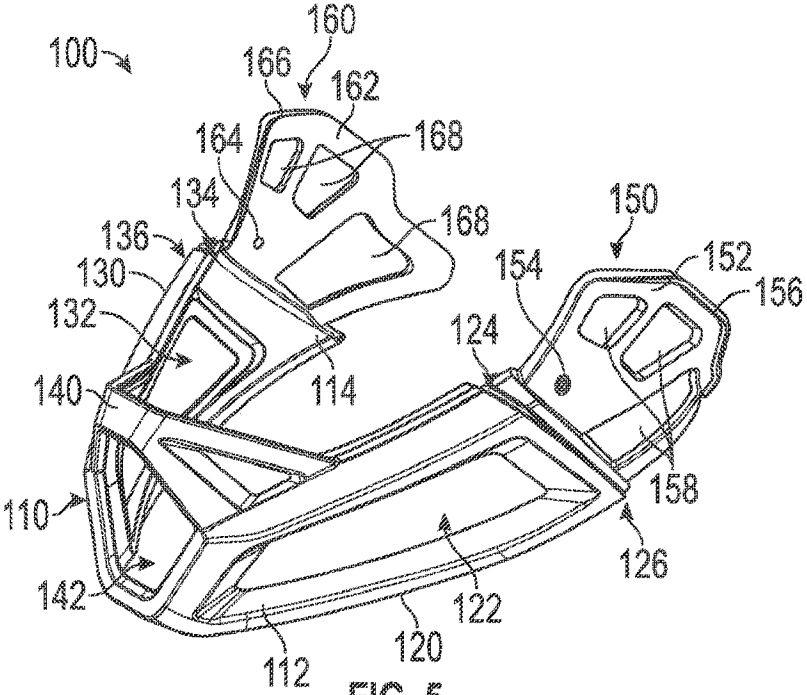
FIG. 5 is a front perspective view of a chinbar, according to an exemplary embodiment.

As shown in FIGS. 4-5, and 10, the right extension plate 152 of the right flange 150 and the left extension plate 162 of the left flange 160 are positioned towards with the interior 114 of the cage 110 (e.g., the right flange 150 and the left flange 160 are offset from the exterior 112, the right extension plate 152 is thinner than the right padding engagement surface 124, the left extension plate 162 is thinner than the left padding engagement surface 134, etc.). In other embodiments, the right extension plate 152 of the right flange 150 and/or the left extension plate 162 of the left flange 160 are flush with and/or positioned towards the exterior 112 of the cage 110 (e.g., the right flange 150 and/or the left flange 160 are offset from the interior 114, etc.). In still other embodiments, the right extension plate 152 of the right flange 150 and/or the left extension plate 162 of the left flange 160 are disposed between the exterior 112 and the interior 114 (e.g., offset from both the exterior 112 and the interior 114, etc.). In yet another embodiment, the right extension plate 152 of the right flange 150 and/or the left extension plate 162 of the left flange 160 are flush with the exterior 112 and the interior 114 of the cage 110 (e.g., the right extension plate 152 is the same thickness as the right padding engagement surface 124, the left extension plate 162 is the same thickness as the left padding engagement surface 134, etc.).

Figure 6:
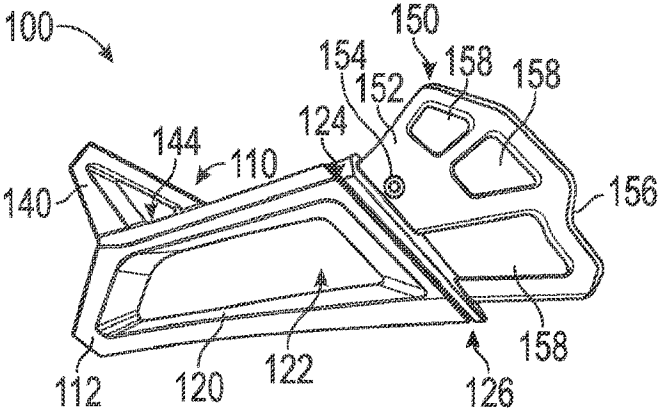
FIG. 6 is a side plan view of the chinbar of FIG. 5, according to an exemplary embodiment.

As shown in FIGS. 5-6, the right extension plate 152 defines first plurality of apertures, shown as right cutouts 158, and the left extension plate 162 defines a second plurality of apertures, shown as left cutouts 168. According to an exemplary embodiment, the right cutouts 158 and the left cutouts 168 are configured to enable the padding 40 to flow therethrough during an in-molding process (e.g., forming around and through the right extension plate 152 and the left extension plate 162, etc.) to securely embed the right flange 150 and the left flange 160 within the padding 40. In an alternative embodiment, the right extension plate 152 and/or the left extension plate 162 define a plurality of individual extensions or fingers that fan out within the padding 40, forming gaps between adjacent extensions. In other embodiments, the right extension plate 152 and the left extension plate 162 are otherwise shaped (e.g., web-shaped, hook-shaped, fan-shaped, etc.).

According to an exemplary embodiment, the cage 110 defines a plurality of apertures forming open space within the chinbar 100, thereby reducing an overall weight of the chinbar 100 and the helmet 10, as well as increasing ventilation through the chinbar 100 into the internal cavity 12 of the helmet 10. Such a reduction in weight may be beneficial for various applications to provide a lightweight helmet (e.g., downhill biking, motocross, etc.). As shown in FIGS. 1-2 and 5-8, the right portion 120 of the cage defines a first elongated opening, shown as right cage vent 122, the left portion 130 of the cage 110 defines a second elongated opening, shown as left cage vent 132, and the central portion 140 defines a plurality of central openings, shown as central cage vent 142 and central cage vents 144. In some embodiments, the right cage vent 122, the left cage vent 132, the central cage vent 142, and/or the central cage vents 144 are covered with a screen or mesh-like material (e.g., to prevent debris, bugs, dirt, etc. from entering into the internal cavity 12 of the helmet 10 thought the chinbar 100, etc.).

According to the exemplary embodiment shown in FIGS. 1-2 and 5-8, the right cage vent 122 extends along the right portion 120 of the cage 110 such that a portion of the right portion 120 includes open space or open area (e.g., between 5% to 95% by volume, by area, etc. of open space). According to the exemplary embodiment shown in FIGS. 1-2, 5, and 7-8, the left cage vent 132 extends along the left portion 130 of the cage 110 such that a portion of the left portion 130 includes open space or open area (e.g., between 5% to 95% by volume, by area, etc. of open space). According to the exemplary embodiment shown in FIGS. 1-2 and 5-8, the central cage vent 142 and the central cage vents 144 form openings within the central portion 140 such that the central portion 140 includes open space or open area (e.g., between 5% to 95% by volume, by area, etc. of open space). In other embodiments, the cage 110 defines differently shaped, differently sized, and/or a greater or a fewer quantity of vents. In an alternative, the cage 110 does not define at least one of the right cage vent 122, the left cage vent 132, the central cage vent 142, and the central cage vents 144.

According to an exemplary embodiment, the vents (e.g., the right cage vent 122, the left cage vent 132, the central cage vent 142, the central cage vents 144, etc.) of the chinbar 100 include open space or open area that accounts for a majority of the chinbar 100 (e.g., the open space accounts for greater than 50% of the volume of the cage 110; greater than 50% of the surface area of the exterior 112 of the cage 110 is removed to form open space; any sub-range between 50% and 95% or any sub-value therebetween; as much as manufacturing allows; without affecting the structural integrity of the chinbar 100; etc.). In one embodiment, the chinbar 100 includes about 50%-95% open space or open area. In another embodiment, the chinbar 100 includes about 0%-50% open space or open area. In an alternative embodiment, chinbar 100 does not include open space or open area. Therefore, the vents of the chinbar 100 may cover, for example, anywhere from 0% to 95% of the cage 110, including any sub-value or sub-range therein (e.g., 5%, 20%, 40%, 50%, 60%, 70%, 75%, 90%, or any sub-range bound by the same, etc.), In some embodiments, one or more of the vents of the chinbar 100 (e.g., the right cage vent 122, the left cage vent 132, the central cage vent 142, the central cage vents 144, etc.) are formed from and/or include a mesh material (e.g., wire mesh, etc.) positioned to prevent debris (e.g., dirt, rocks, etc.) from entering into the internal cavity 12 of the helmet 10 through the vents of the chinbar 100.

According to various embodiments, the chinbar 100 is manufactured from, but is not limited to, a lightweight plastic, a plastic composite, Kevlar, carbon fiber, aramid fiber, fiberglass, polycarbonate, and/or ABS, among other possible materials. According to an exemplary embodiment, the unitary structure of the chinbar 100 facilitates manufacturing the chinbar 100 independent of the helmet shell 20 and/or the padding 40 with rigidity and a lower overall weight (e.g., due to the vents, the embedded flanges, the ability to independently select a desired material, the ability to optimize thickness and other dimensioning, etc.). According to an exemplary embodiment, the unitary structure of the chinbar 100 facilitates manufacturing the chinbar 100 from a material that is different than the material of at least one of the helmet shell 20 and the padding 40. In one embodiment, the material of the chinbar 100 is different than the material of the helmet shell 20 and the material of the padding 40 (e.g., the chinbar 100 is manufactured from a material that is unique to the helmet 10, etc.). In other embodiments, the material of the chinbar 100 and the material of the helmet shell 20 are the same.

According to an exemplary embodiment, the unitary structure of the chinbar 100 facilitates manufacturing the right portion 120 (e.g., the right padding engagement surface 124, etc.), the left portion 130 (e.g., the left padding engagement surface 134, etc.), and/or of the central portion 140 of the cage 110 with a different size (e.g., thickness, width, dimensions, etc.) than at least one of the helmet shell 20 and the padding 40 (e.g., the right chinbar engagement surface 52, the left chinbar engagement surface 62, etc.). For example, the unitary structure of the chinbar 100 may allow the helmet shell 20 to be relatively thin (e.g., relative to the cage 110, the padding 40, further reducing the weight of the helmet 10, etc.). Further, the cage 110 may be thicker than the helmet shell 20 and/or the padding 40 to increase impact absorption ability of the chinbar 100 and the helmet 10 as a complete unit. Therefore, the chinbar 100 being an individual component of the helmet 10 may facilitate reducing the overall weight of the helmet 10 (e.g., a lightweight construction, etc.), increasing ventilation, and satisfying and/or exceeding various helmet impact standards (e.g., ASTM F1952, etc.).

In some embodiments, the chinbar 100 has different thicknesses (e.g., a variable thickness, etc.) along the cage 110. For example, the central portion 140 and/or the frontal portions of the right portion 120 and the left portion 130 may have a different thickness than the rear portions of the right portion 120 and the left portion 130. For example, the front portions may have a first thickness or density to facilitate absorbing greater impacts, while the rear portions may have a second thickness or density for increased stability between the attachment of the helmet shell 20, the padding 40, and the chinbar 100. In some embodiments, the right portion 120, the left portion 130, and/or the central portion 140 of the cage 110 form hollow tubular sections of the chinbar 100 (e.g., the cage 110 is hollow, an air gap is formed between the exterior 112 and the interior 114 of the cage 110, etc.).

According to the exemplary embodiment shown in FIGS. 10-13, a method for manufacturing the helmet 10 is visually depicted. As shown in FIG. 10, the helmet shell 20, the padding 40, the visor 70, the right vent cap 80, the left vent cap 90, and the chinbar 100 are independent components of the helmet 10 that are independently manufactured or formed. For example, the chinbar 100 of the helmet 10 is formed in a first forming operation, the padding 40 of the helmet 10 is formed in a second forming operation, the helmet shell 20 of the helmet 10 is formed in a third forming operation, the visor 70 is formed in a fourth forming operation, the right vent cap 80 is formed in a fifth forming operation, and the left vent cap 90 is formed in a sixth forming operation. The forming operations may include at least one of molding, injection molding, co-molding, over-molding, in-molding, compression molding, extrusion molding, thermoforming, and/or vacuum forming, among other possible forming operations.

As shown in FIGS. 10-11, the chinbar 100 is attached to the padding 40. The attachment may include embedding the right flange 150 (e.g., the right extension plate 152, the right aperture 154, the lip 156, etc.) within the right side 50 of the padding 40 such that the right padding engagement surface 124 of the right portion 120 of the cage 110 interfaces with the tight chinbar engagement surface 52 of the padding 40 and the right aperture 154 of the right flange 150 aligns with the right aperture 54 of the padding 40. The attachment may further include embedding the left flange 160 (e.g., the left extension plate 162, the left aperture 164, the lip 166, etc.) within the left side 60 of the padding 40 such that the left padding engagement surface 134 of the left, portion 130 of the cage 110 interfaces with the left chinbar engagement surface 62 of the padding 40 and the left aperture 164 of the left flange 160 aligns with the left aperture 64 of the padding 40.

In one embodiment, embedding the right flange 150 and/or the left flange 160 within the padding 40 includes molding (e.g., over-molding, etc.) the padding 40 around and/or over the right flange 150 and/or the left flange 160 of the chinbar 100. In another embodiment, embedding the right flange 150 and/or the left flange 160 within the padding 40 includes inserting the right flange 150 and/or the left flange 160 through apertures or slots defined by the right chinbar engagement surface 52 and/or the left chinbar engagement surface 62 of the padding 40, respectively.

As shown in FIGS. 11-12, the right vent cap 80 and/or the left vent cap 90 are attached to the padding 40. The attachment of the right vent cap 80 to the padding 40 may include disposing the engagement plate 82 of the right vent cap 80 onto the right vent engagement surface 56 of the padding 40 such that the attachment plate 84 of the right vent cap 80 extends over the right aperture 54 of the padding 40, aligning the right aperture 88 of the right vent cap 80 with the right aperture 54 of the padding 40. The attachment of the left vent cap 90 to the padding 40 may include disposing the engagement plate 92 of the left vent cap 90 onto the left vent engagement surface 66 of the padding 40 such that the attachment plate 94 of the left vent cap 90 extends over the left aperture 64 of the padding 40, aligning the left aperture 98 of the left vent cap 90 with the left aperture 64 of the padding 40.

Figure 13:
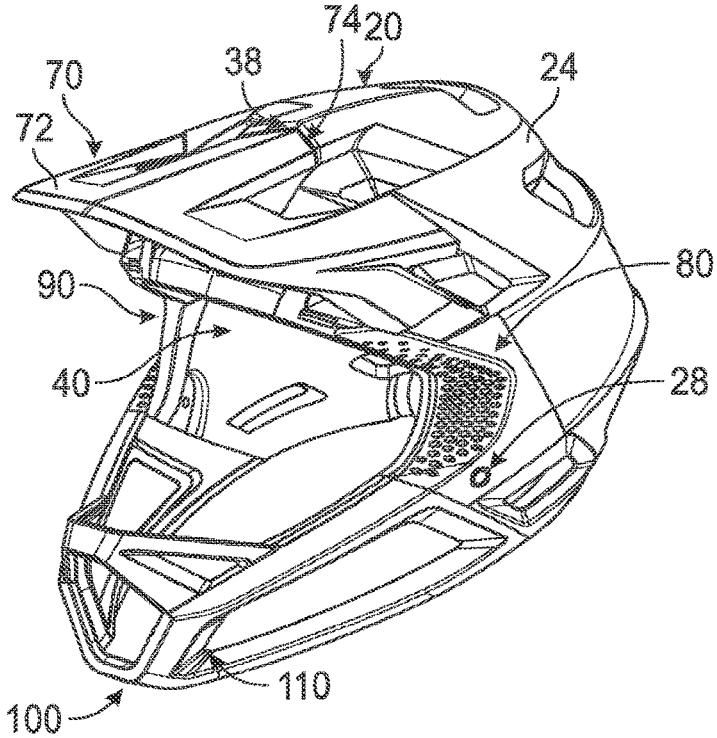

As shown in FIGS. 12-13, the padding 40 is inserted (e.g., in-molded, etc.) into the helmet shell 20 such that the outer surface 42 of the padding 40 is disposed along the interior surface 26 of the helmet shell 20 and attached thereto (e.g., mechanically, with fasteners, with adhesive, etc.) such that the right aperture 28 and the left aperture 30 of the helmet shell 20 align with the right aperture 88 of the right vent cap 80 and the left aperture 98 of the left vent cap 90, respectively. In embodiments without the right vent cap 80 and the left vent cap 90, the right aperture 28 and the left aperture 30 of the helmet shell 20 align with the right aperture 54 and the left aperture 64 of the padding 40, respectively, A first fastener may be inserted through the right apertures 28, 54, 88, and/or 154 and a second fastener may be inserted through the left apertures 30, 64, 98, and/or 164 to secure the helmet shell 20, the padding 40, the right vent cap 80, the left vent cap 90, and/or the chinbar 100 together. The visor 70 may be attached to the upper, front surface 38 of the helmet shell 20 (e.g., mechanically, magnetically, with fasteners, etc.).

It should be noted that the order in which FIGS. 10-13 are presented may not represent the order in which the manufacturing process of the helmet 10 occurs. The order shown in FIGS. 10-13 was selected to clarify how each component of the helmet 10 interfaces with one another. The outer casing of the helmet 10 (e.g., the chinbar 100 and the helmet shell 20, etc.) may actually be coupled together first and then the padding 40 is in-molded (e.g., injected, shot, etc.) into the internal cavity 12 such that the chinbar 100 becomes embedded within the padding 40. Other variations in the manufacturing process are possible, according to other alternative embodiments.

For example, a method of manufacturing the helmet 10 may be as follows, First, the chinbar 100 of the helmet 10 is formed in a first forming operation. Second, the helmet shell 20 of the helmet 10 is formed in a second forming operation. Third, the chinbar 100 is coupled to the helmet shell 20 such that the right flange 150 and the left flange 160 extend within the internal cavity 12 of the helmet shell 20. Fourth, the padding 40 is in-molded (e.g., injected, shot, etc.) within the internal cavity 12 of the helmet shell 20 such that the right flange 150 and the left flange 160 of the chinbar 100 become embedded within the padding 40. In an alternative embodiment, the padding 40 is over-molded onto the chinbar 100 (e.g., over the right flange 150 and the left flange 160, etc. and then the padding 40 is inserted into the internal cavity 12 of the helmet shell 20.

It is important to note that the construction and arrangement of the elements of the systems, methods, and apparatuses as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. It should be noted that the elements and/or assemblies of the enclosure may be constructed from any of a wide variety of materials that provide sufficient strength or durability, in any of a wide variety of colors, textures, and combinations.

Embodiments have been described in connection with the accompanying drawings. However, it should be understood that the figures are not drawn to scale. Distances, angles, shapes, etc. are merely illustrative and do not necessarily bear an exact relationship to actual dimensions and layout of the articles that are illustrated. In addition, the foregoing embodiments have been described at a level of detail to allow one of ordinary skill in the art to make and use the articles, parts, different materials, etc. described herein. A wide variety of variation is possible. Articles, materials, elements, and/or steps can be altered, added, removed, or rearranged. While certain embodiments have been explicitly described, other embodiments will become apparent to those of ordinary skill in the art based on this disclosure.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or configurations are in any way required for one or more embodiments. The terms "comprising," "including," "having," and the like are synonymous and are used inclusively, in an open-ended fashion, and do not exclude additional elements, features, acts, operations, and so forth. The term "consisting essentially of" can be used anywhere where the terms comprising, including, containing or having are used herein, but consistent essentially of is intended to mean that the claim scope covers or is limited to the specified materials or steps recited and those that do not materially affect the basic and novel characteristic(s) of the claimed invention. Also, the term "consisting of" can be used anywhere where the terms comprising, including, containing or having are used herein, but consistent of excludes any element, step, or ingredient not specified in a given claim where it is used.

Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, and/or Z. Thus, such conjunctive language is not generally intended to imply that certain embodiments require at least one of X, at least one of Y, and at least one of Z to each be present.

Additionally, in the subject description, the word "exemplary" is used to mean serving as an example, instance, or illustration. Any embodiment or design described herein as "exemplary" is not necessarily to be construed as preferred or advantageous over other embodiments or designs. Rather, use of the word exemplary is intended to present concepts in a concrete manner. Accordingly, all such modifications are intended to be included within the scope of the present inventions. Other substitutions, modifications, changes, and omissions may be made in the design, operating conditions, and arrangement of the preferred and other exemplary embodiments without departing from scope of the present disclosure or from the spirit of the appended claims.

What is claimed is:

1. A helmet, comprising:

a shell having a front opening;

a padding coupled to an interior surface of the shell, the padding having a lateral side portion; and a chinbar extending around the front opening, the chinbar comprising:

an attachment end adjacent to the lateral side portion of the padding, a flange extending from the attachment end and having flange apertures extending therethrough, wherein the flange is encased within the lateral side portion of the padding and the padding extends through the flange apertures; and wherein a continuous bottom edge of the helmet defined by a portion of the shell and the chinbar extends around a lower portion of a wearer's head when the helmet is worn.

2. The helmet of claim 1, wherein the padding comprises (i) an outer layer coupled to the interior surface of the shell and molds over the first flange and the second flange, and (ii) an inner layer configured to conform to the head of the wearer.

3. The helmet of claim 2, wherein the outer layer includes a first material having a first density, and the inner layer includes a second material having a second density different than the first density.

4. The helmet of claim 1, wherein the chinbar includes an chinbar exterior surface, wherein the flange includes a flange exterior surface, and wherein the flange exterior surface is offset toward an interior of the helmet from the chinbar exterior surface.

5. The helmet of claim 1, further comprising a fastener extending through coaxially aligned holes in the shell and the chinbar to secure the chinbar to the shell.

6. The helmet of claim 1, wherein the flange apertures include a distal aperture, and a portion of the flange extends between the attachment end and the distal aperture.

7. The helmet of claim 1, wherein the flange apertures includes a proximal aperture, wherein an edge of the proximate aperture is coincident an engagement surface of the attachment end.

8. The helmet of claim 1, wherein the chinbar has a second flange extending from a second attachment end and having a plurality of second flange apertures extending therethrough, and the second flange is encased within the padding with the padding extending through the plurality of second flange apertures.

9. The helmet of claim 8, wherein the chinbar includes a first inner surface and a first outer surface, wherein the flange has a second inner surface and a second outer surface, wherein the second outer surfaces are offset toward an interior of the helmet from the first outer surface, and wherein the second inner surfaces are offset toward an exterior of the helmet from the first inner surface.

* * * * *